US009557693B2

(12) United States Patent
Ono

(10) Patent No.: US 9,557,693 B2
(45) Date of Patent: Jan. 31, 2017

(54) FIXING DEVICE AND IMAGE FORMING APPARATUS

(71) Applicant: Hiroshi Ono, Tokyo (JP)

(72) Inventor: Hiroshi Ono, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/626,168

(22) Filed: Feb. 19, 2015

(65) Prior Publication Data

US 2015/0261153 A1 Sep. 17, 2015

(30) Foreign Application Priority Data

Mar. 12, 2014 (JP) ..... 2014-049356
Jun. 9, 2014 (JP) ..... 2014-118487

(51) Int. Cl.
*G03G 15/20* (2006.01)

(52) U.S. Cl.
CPC ..... *G03G 15/206* (2013.01); *G03G 15/2057* (2013.01); *G03G 15/2085* (2013.01); *G03G 15/2089* (2013.01); *G03G 2215/2048* (2013.01)

(58) Field of Classification Search
CPC ..... G03G 15/2085; G03G 15/2089; G03G 15/2057; G03G 15/206; G03G 2215/2048
See application file for complete search history.

(56) References Cited

U.S. PATENT DOCUMENTS

| | | | | |
|---|---|---|---|---|
| 4,580,033 | A * | 4/1986 | Sakurai | 399/333 |
| 5,763,129 | A * | 6/1998 | Chen et al. | 399/333 |
| 6,400,923 | B1 * | 6/2002 | Fukuda et al. | 399/333 |
| 2010/0286327 | A1 * | 11/2010 | Moorlag | G03G 15/2057 524/496 |

FOREIGN PATENT DOCUMENTS

| | | |
|---|---|---|
| JP | 8-016020 | 1/1996 |
| JP | 8-137330 | 5/1996 |
| JP | 8-220922 | 8/1996 |
| JP | 2002-072742 | 3/2002 |
| JP | 2002-351247 | 12/2002 |
| JP | 2011-095306 | 5/2011 |

* cited by examiner

*Primary Examiner* — Ryan Walsh
(74) *Attorney, Agent, or Firm* — Harness, Dickey & Pierce, P.L.C.

(57) ABSTRACT

A fixing device includes a heating rotator and a pressure rotator pressed against the heating rotator to form a fixing nip therebetween, through which a recording medium bearing a toner image is conveyed. A plurality of first recesses is scattered on a circumferential face of the heating rotator. A plurality of second recesses is scattered on a circumferential face of the pressure rotator. Each of the second recesses is greater than each of the first recesses.

12 Claims, 5 Drawing Sheets

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2014-049356, filed on Mar. 12, 2014, and 2014-118487, filed on Jun. 9, 2014, in the Japanese Patent Office, the entire disclosure of each of which is hereby incorporated by reference herein.

BACKGROUND

Technical Field

Example embodiments generally relate to a fixing device and an image forming apparatus, and more particularly, to a fixing device for fixing a toner image on a recording medium and an image forming apparatus incorporating the fixing device.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a heating rotator, such as a heating roller and an endless belt, heated by a heater and a pressure rotator, such as a pressure roller and a pressure belt, pressed against the heating rotator to form a fixing nip therebetween through which a recording medium bearing a toner image is conveyed. As the recording medium bearing the toner image is conveyed through the fixing nip, the heating rotator and the pressure rotator apply heat and pressure to the recording medium, melting and fixing the toner image on the recording medium.

SUMMARY

At least one embodiment provides a novel fixing device that includes a heating rotator and a pressure rotator pressed against the heating rotator to form a fixing nip therebetween, through which a recording medium bearing a toner image is conveyed. A plurality of first recesses is scattered on a circumferential face of the heating rotator. A plurality of second recesses is scattered on a circumferential face of the pressure rotator. Each of the second recesses is greater than each of the first recesses.

At least one embodiment provides a novel image forming apparatus that includes an image forming device to form a toner image and a fixing device, disposed downstream from the image forming device in a recording medium conveyance direction, to fix the toner image on a recording medium. The fixing device includes a heating rotator and a pressure rotator pressed against the heating rotator to form a fixing nip therebetween, through which the recording medium bearing the toner image is conveyed. A plurality of first recesses is scattered on a circumferential face of the heating rotator. A plurality of second recesses is scattered on a circumferential face of the pressure rotator. Each of the second recesses is greater than each of the first recesses.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
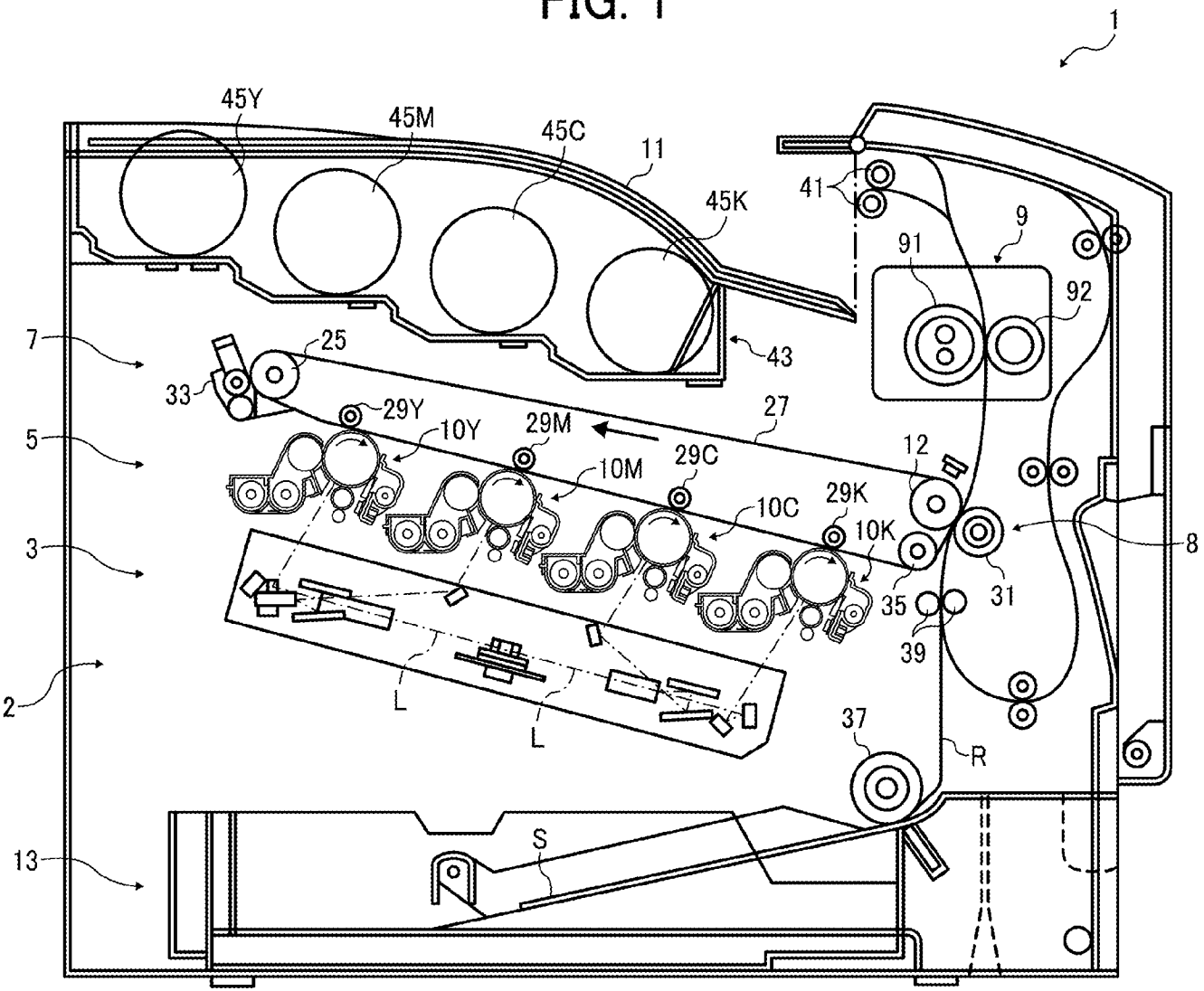
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a color printer that forms color and monochrome toner images on recording media by electrophotography. Alternatively, the image forming apparatus 1 may be a monochrome printer that forms monochrome toner images.

Figure 2:
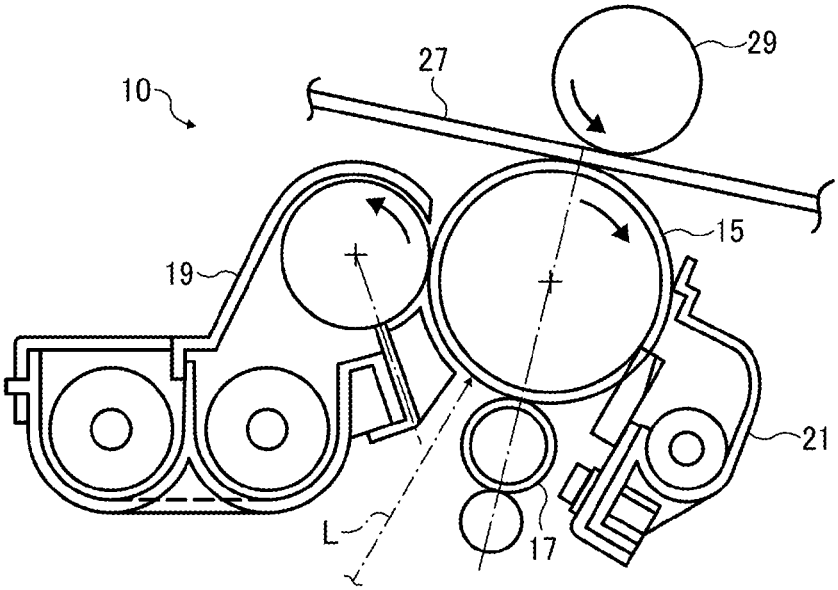
FIG. 2 is a schematic vertical sectional view of a process cartridge incorporated in the image forming apparatus shown in FIG. 1.

With reference to FIGS. 1 and 2, a description is provided of a construction of the image forming apparatus 1.

FIG. 1 is a schematic vertical sectional view of the image forming apparatus 1. FIG. 2 is a schematic vertical sectional view of a process cartridge 10 incorporated in the image forming apparatus 1 shown in FIG. 1.

As shown in FIG. 1, the image forming apparatus 1 includes an exposure device 3 that emits a laser beam L and a process unit 5 that forms an electrostatic latent image with the laser beam L and visualizes the electrostatic latent image into a toner image. The image forming apparatus 1 further includes an intermediate transfer unit 7 that bears the toner image primarily transferred from the process unit 5, a secondary transferor 8 that secondarily transfers the toner image from the intermediate transfer unit 7 onto a recording medium S (e.g., a sheet), and a fixing device 9 that fixes the toner image secondarily transferred by the secondary transferor 8 onto the recording medium S thereon. The image forming apparatus 1 further includes a tray 11 that temporarily stores the recording medium S bearing the fixed toner image, a paper tray 13 that loads a plurality of recording media S to be conveyed to the secondary transferor 8, an output roller pair 41 that ejects the recording medium S bearing the fixed toner image onto the tray 11, and a bottle housing 43 that holds tonner bottles 45Y, 45M, 45C, and 45K. The exposure device 3, the process unit 5, the intermediate transfer unit 7, and the secondary transferor 8 are combined into an image forming device 2 as one example. The fixing device 9 is one example embodiment of the present disclosure.

A detailed description is now given of a construction of the exposure device 3.

As shown in FIGS. 1 and 2, the exposure device 3 irradiates an outer circumferential surface of a photoconductive drum 15 charged by a charger 17 with a laser beam L according to image data, forming an electrostatic latent image on the photoconductive drum 15. The exposure device 3 includes a light source including a semiconductor laser that emits the laser beam L, an optical deflector that deflects the laser beam L in a main scanning direction, an optical scanner system that condenses the deflected laser beam L onto the outer circumferential surface of the photoconductive drum 15 as a scanned face.

A detailed description is now given of a construction of the process unit 5.

The process unit 5 performs a series of processes repeatedly: a process to charge the outer circumferential surface of the photoconductive drum 15; a process to develop the electrostatic latent image formed on the outer circumferential surface of the photoconductive drum 15 into a toner image; and a process to remove residual toner failed to be transferred onto the intermediate transfer unit 7 and therefore remaining on the outer circumferential surface of the photoconductive drum 15 therefrom.

As shown in FIG. 1, the process unit 5 includes process cartridges 10Y, 10M, 10C, and 10K that form yellow, magenta, cyan, and black toner images, respectively. Suffixes Y, M, C, and K defining yellow, magenta, cyan, and black are assigned to components used to form the yellow, magenta, cyan, and black toner images, respectively. The image forming apparatus 1 is a tandem image forming apparatus incorporating the aligned process cartridges 10Y, 10M, 10C, and 10K.

Each of the process cartridges 10Y, 10M, 10C, and 10K is detachably attached to the image forming apparatus 1 for replacement with new one when its operational life comes to an end or it is consumed.

A detailed description is now given of a construction of the process cartridges 10Y, 10M, 10C, and 10K.

Since the process cartridges 10Y, 10M, 10C, and 10K have an identical construction, the following describes the construction of the process cartridges 10Y, 10M, 10C, and 10K without referring to the color of toner used in the process cartridges 10Y, 10M, 10C, and 10K. Hence, in FIG. 2, the suffixes Y, M, C, and K for identification of the color of toner are omitted and therefore each of the process cartridges 10Y, 10M, 10C, and 10K is identified as the process cartridge 10.

As shown in FIG. 2, the process cartridge 10 includes the photoconductive drum 15 that bears an electrostatic latent image formed by a laser beam L emitted by the exposure device 3 depicted in FIG. 1 and the charger 17 that charges the photoconductive drum 15. The process cartridge 10 further includes a developing device 19 that develops the electrostatic latent image into a toner image and a cleaner 21 that cleans the outer circumferential surface of the photoconductive drum 15. The developing device 19 accommodates yellow, magenta, cyan, or black toner that corresponds to a color separation component of a color toner image.

The photoconductive drum 15 includes an organic photoconductive layer on which an electrostatic latent image is formed by a laser beam L scanning the photoconductive drum 15 according to an image formation signal. The developing device 19 supplies toner to the electrostatic latent image formed on the photoconductive drum 15 to visualize the electrostatic latent image into an unfixed toner image. The charger 17 applies a charging bias to the photoconductive drum 15 to uniformly charge the outer circumferential surface of the photoconductive drum 15 at desired polarity and potential. The developing device 19 adheres toner to the electrostatic latent image formed on the outer circumferential surface of the photoconductive drum 15, thus developing the electrostatic latent image into the toner image. The cleaner 21 removes residual toner failed to be transferred onto the intermediate transfer unit 7 and therefore remaining on the outer circumferential surface of the photoconductive drum 15 therefrom.

A detailed description is now given of a construction of the intermediate transfer unit 7.

As shown in FIG. 1, the intermediate transfer unit 7 primarily transfers the toner image formed on the outer circumferential surface of the photoconductive drum 15 onto a surface of a recording medium S. The intermediate transfer unit 7 includes an endless intermediate transfer belt 27, a cleaning backup roller 25, and a secondary transfer backup roller 12. The intermediate transfer belt 27 is stretched taut across the cleaning backup roller 25 and the secondary transfer backup roller 12 and rotatable counterclockwise in FIG. 1. The intermediate transfer unit 7 further includes a plurality of primary transfer rollers 29Y, 29M, 29C, and 29K disposed opposite the plurality of photoconductive drums 15 that bears yellow, magenta, cyan, and black toner images, respectively. The primary transfer rollers 29Y, 29M, 29C, and 29K press the intermediate transfer belt 27 against the photoconductive drums 15, respectively. The intermediate transfer unit 7 further includes a belt cleaner 33. The intermediate transfer belt 27 rotates counterclockwise in FIG. 1 in a state in which it is applied with given tension by a tension roller 35.

The primary transfer rollers 29Y, 29M, 29C, and 29K are applied with a primary transfer bias having a polarity opposite a polarity of electric charge of toner. Accordingly, each of the primary transfer rollers 29Y, 29M, 29C, and 29K attracts toner from the outer circumferential surface of the photoconductive drum 15 to an outer circumferential surface of the intermediate transfer belt 27, thus primarily transferring the toner image formed on the photoconductive drum 15 onto the intermediate transfer belt 27.

A detailed description is now given of a construction of the secondary transferor 8.

The secondary transferor 8 includes a secondary transfer roller 31 that presses the recording medium S against the intermediate transfer belt 27. The secondary transfer roller 31 is disposed opposite the secondary transfer backup roller 12. The secondary transfer roller 31 is applied with a secondary transfer bias having a polarity opposite the polarity of electric charge of toner. Accordingly, the secondary transfer roller 31 attracts toner from the outer circumferential surface of the intermediate transfer belt 27 to the recording medium S, thus secondarily transferring the toner image formed on the intermediate transfer belt 27 onto the recording medium S.

The belt cleaner 33 includes a cleaning blade that contacts the intermediate transfer belt 27 and a blade holder that holds the cleaning blade. The cleaning blade is in contact with and directed to the intermediate transfer belt 27 in a direction counter to a rotation direction of the intermediate transfer belt 27, damming up and removing residual toner failed to be transferred onto the recording medium S and therefore remaining on the outer circumferential surface of the intermediate transfer belt 27 therefrom.

A detailed description is now given of a construction of the fixing device 9.

The fixing device 9 (e.g., a fuser or a fusing unit) fixes the toner image on the recording medium S under heat and pressure. The fixing device 9 includes a heating roller 91 and a pressure roller 92 pressed against the heating roller 91.

A detailed description is now given of a configuration of the paper tray 13.

The paper tray 13 is situated in a lower portion of the image forming apparatus 1. The paper tray 13 loads a plurality of recording media S (e.g., sheets). A feed roller 37 picks up and feeds a recording medium S one by one to a recording medium conveyance path R extending inside the image forming apparatus 1.

A detailed description is now given of a construction of the bottle housing 43.

The bottle housing 43 is situated in an upper portion of the image forming apparatus 1. The bottle housing 43 accommodates the toner bottles 45Y, 45M, 45C, and 45K. The toner bottles 45Y, 45M, 45C, and 45K contain fresh yellow, magenta, cyan, and black toner corresponding to color separation components of a color toner image, respectively.

The toner bottles 45Y, 45M, 45C, and 45K are connected to the developing devices 19 of the process cartridges 10Y, 10M, 10C, and 10K through toner supply tubes, respectively. As an amount of toner contained in the developing devices 19 decreases to a given level or lower, fresh yellow, magenta, cyan, and black toner contained in the toner bottles 45Y, 45M, 45C, and 45K is supplied to the developing devices 19, respectively.

With reference to FIGS. 1 and 2, a description is provided of an image forming operation performed by the image forming apparatus 1 having the construction described above to form a toner image on a recording medium S.

As the image forming apparatus 1 receives a print job, the photoconductive drums 15 of the process cartridges 10Y, 10M, 10C, and 10K, respectively, are driven and rotated clockwise in FIG. 1. The chargers 17 uniformly charge the outer circumferential surface of the photoconductive drums 15, respectively, at a given polarity.

The exposure device 3 emits a laser beam L onto the charged outer circumferential surface of the respective photoconductive drums 15, forming an electrostatic latent image thereon. Image data used to expose the respective photoconductive drums 15 is monochrome image data produced by decomposing a desired color image into yellow, magenta, cyan, and black image data.

The developing devices 19 supply yellow, magenta, cyan, and black toner to the electrostatic latent images formed on the outer circumferential surface of the photoconductive drums 15, visualizing the electrostatic latent images into yellow, magenta, cyan, and black toner images, respectively. The primary transfer rollers 29Y, 29M, 29C, and 29M are applied with a primary transfer bias. Accordingly, the yellow, magenta, cyan, and black toner images formed on the photoconductive drums 15, respectively, are primarily transferred onto the intermediate transfer belt 27 rotating counterclockwise in FIG. 1 successively such that the yellow, magenta, cyan, and black toner images are superimposed on a same position on the intermediate transfer belt 27. After the primary transfer of the yellow, magenta, cyan, and black toner images from the photoconductive drums 15 onto the intermediate transfer belt 27, the cleaners 21 remove residual toner failed to be transferred onto the intermediate transfer belt 27 and therefore remaining on the outer circumferential surface of the respective photoconductive drums 15 therefrom.

The feed roller 37 rotated by a driver picks up and feeds a recording medium S from the paper tray 13 to the recording medium conveyance path R. A registration roller pair 39 conveys the recording medium S sent to the recording medium conveyance path R to a secondary transfer nip formed between the intermediate transfer belt 27 and the secondary transfer roller 31 disposed opposite the secondary transfer backup roller 12 via the intermediate transfer belt 27 at a proper time. The secondary transfer roller 31 is applied with a secondary transfer bias that secondarily transfers the yellow, magenta, cyan, and black toner images formed on the intermediate transfer belt 27 onto the recording medium S collectively, thus forming a color toner image on the recording medium S. After the secondary transfer of the color toner image from the intermediate transfer belt 27 onto the recording medium S, the belt cleaner 33 removes residual toner failed to be transferred onto the recording medium S and therefore remaining on the outer circumferential surface of the intermediate transfer belt 27 therefrom.

The recording medium S bearing the color toner image is conveyed to the fixing device 9 that fixes the color toner image on the recording medium S under heat and pressure as the recording medium S is conveyed through a fixing nip formed between the heating roller 91 and the pressure roller 92. The recording medium S discharged from the fixing nip is ejected onto the tray 11 by the output roller pair 41.

Figure 3:
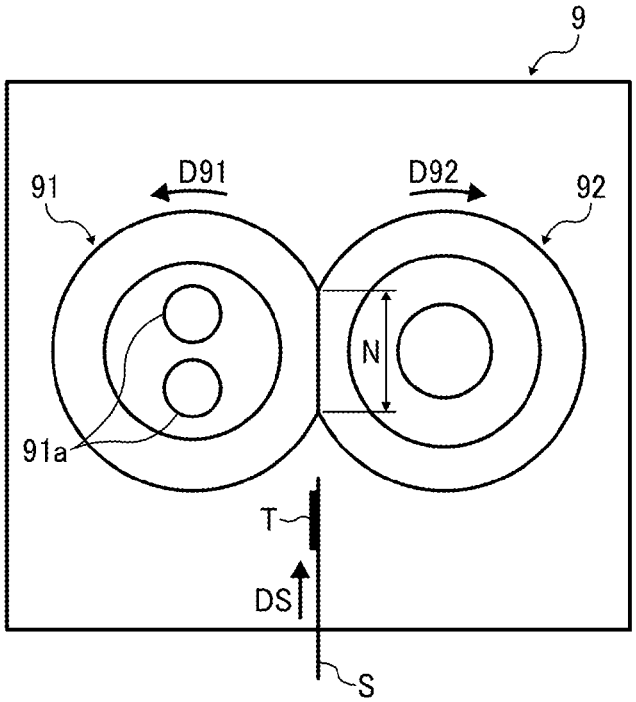
FIG. 3 is a schematic vertical sectional view of a fixing device incorporated in the image forming apparatus shown in FIG. 1.
Figure 4:
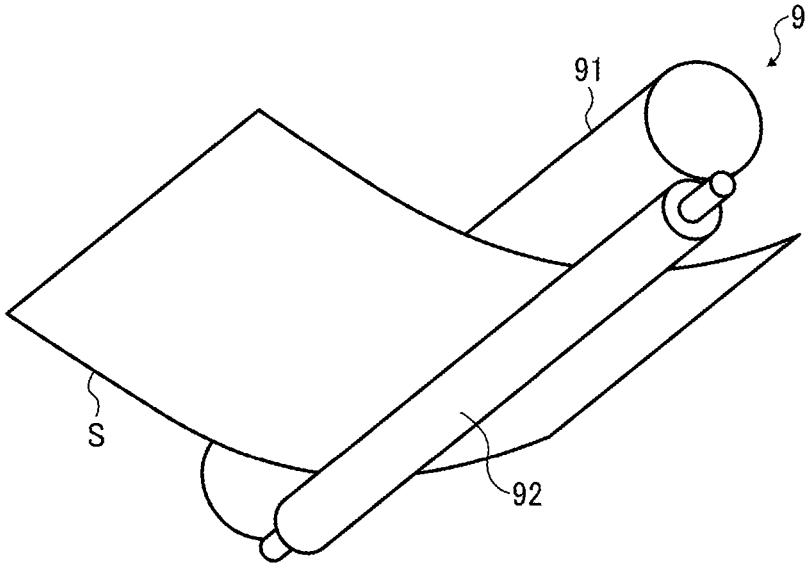
FIG. 4 is a schematic perspective view of the fixing device shown in FIG. 3.

With reference to FIGS. 3 and 4, a description is provided of a construction of the fixing device 9 in detail.

FIG. 3 is a schematic vertical sectional view of the fixing device 9. FIG. 4 is a schematic perspective view of the fixing device 9 shown in FIG. 3. As shown in FIGS. 3 and 4, the fixing device 9 includes the heating roller 91 and the pressure roller 92.

The heating roller 91 houses a heat source 91*a* (e.g., a halogen heater) that heats the heating roller 91 as the heating roller 91 rotates in a rotation direction D91. According to this example embodiment, the heat source 91*a* is constructed of two halogen heaters. A spring or the like presses the pressure roller 92 against the heating roller 91 to form a fixing nip N therebetween as the pressure roller 92 rotates in a rotation direction D92. A motor or the like drives and rotates the pressure roller 92 which in turn drives and rotates the heating roller 91 by friction therebetween. After a recording medium S bearing a toner image T conveyed in a recording medium conveyance direction DS enters the fixing nip N, the heating roller 91 and the pressure roller 92 apply heat and pressure to the recording medium S as the recording medium S is conveyed through the fixing nip N by the heating roller 91 and the pressure roller 92 that sandwich the recording medium S. Thus, the toner image T is fixed on the recording medium S under heat and pressure. The recording medium S, after passing through the fixing nip N, is conveyed to a downstream position downstream from the fixing device 9 in the recording medium conveyance direction DS. The heating roller 91 is one example of a heating rotator. The pressure roller 92 is one example of a pressure rotator.

Figure 5:
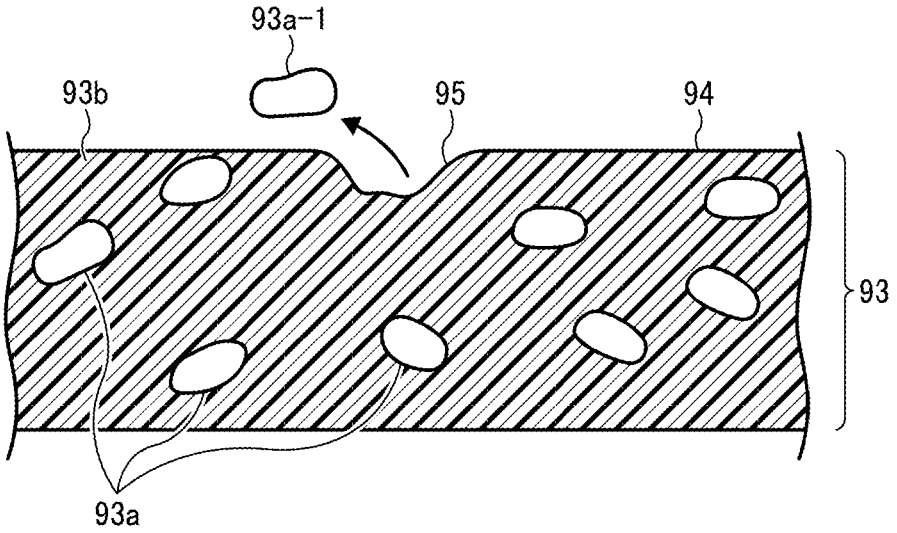
FIG. 5 is a diagram illustrating a surface layer of each of a heating roller and a pressure roller incorporated in the fixing device shown in FIGS. 3 and 4.

With reference to FIG. 5, a description is provided of a configuration of a surface layer of each of the heating roller 91 and the pressure roller 92.

According to this example embodiment, the surface layer of each of the heating roller 91 and the pressure roller 92 is made of resin containing a given additive. FIG. 5 is a diagram illustrating the surface layer of each of the heating roller 91 and the pressure roller 92 shown in FIGS. 3 and 4. A configuration of the surface layer of the heating roller 91 is equivalent to that of the surface layer of the pressure roller 92. Hence, FIG. 5 schematically illustrates a surface layer 93 as the surface layer of each of the heating roller 91 and the pressure roller 92.

As shown in FIG. 5, the surface layer 93 is made of resin 93*b* containing an additive 93*a*. Each of the heating roller 91 and the pressure roller 92 includes a circumferential face 94 provided on the surface layer 93 and provided with a plurality of recesses 95 produced by peeling off or lack of an additive 93*a*-1 (e.g., an additive particle) exposed on the circumferential face 94. The recesses 95 are scattered on the circumferential face 94. The recesses 95 serve as one example of a plurality of recesses according to example embodiments of this disclosure.

If a foreign substance such as toner and paper dust adheres to the circumferential face 94 of the heating roller 91 and the pressure roller 92, the circumferential face 94 may be stained with the foreign substance. Additionally, the heating roller 91 contacts the pressure roller 92 at the fixing nip N. Accordingly, the foreign substance adhered to the circumferential face 94 of one of the heating roller 91 and the pressure roller 92 may receive the foreign substance adhered to the circumferential face 94 of another one of the heating roller 91 and the pressure roller 92, enlarging stains on the one of the heating roller 91 and the pressure roller 92. The heating roller 91 contacts an imaged side of the recording medium S that bears the toner image T. Accordingly, if the circumferential face 94 of the heating roller 91 is stained, the stained heating roller 91 may degrade quality of the toner image T on the recording medium S.

Figure 6:
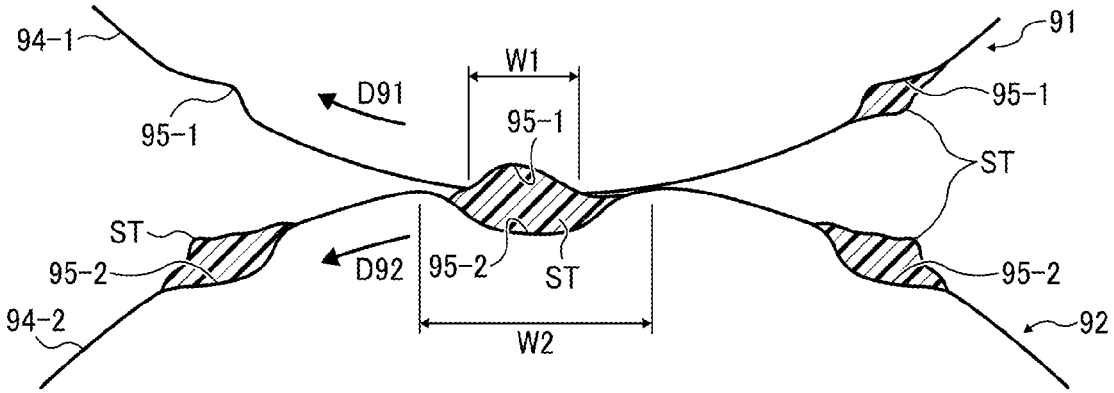
FIG. 6 is a diagram illustrating a plurality of recesses scattered on a circumferential face of the surface layer shown in FIG. 5.

With reference to FIG. 6, a description is provided of a configuration of the recesses 95.

FIG. 6 is a diagram illustrating the plurality of recesses 95 scattered on the circumferential face 94 of each of the heating roller 91 and the pressure roller 92 shown in FIGS. 3 and 4. As shown in FIG. 6, a size W1 of a recess 95-1 on a circumferential face 94-1 of the heating roller 91 is smaller than a size W2 of a recess 95-2 on a circumferential face 94-2 of the pressure roller 92. Such adjustment in size of the recesses 95-1 and 95-2 on the circumferential faces 94-1 and 94-2, respectively, is performed by decreasing the size of the additive 93*a* contained in the surface layer 93 depicted in FIG. 5 of the heating roller 91 relative to the size of the additive 93*a* contained in the surface layer 93 of the pressure roller 92.

According to such adjustment, if a foreign substance ST adheres to the recesses 95-1 and 95-2, the size of the foreign substance ST adhering to the recess 95-1 of the heating roller 91 is smaller than the size of the foreign substance ST adhering to the recess 95-2 of the pressure roller 92. Hence, as the foreign substance ST adhering to the recess 95-1 comes into contact with the foreign substance ST adhering to the recess 95-2 at the fixing nip N, the smaller foreign substance ST adhering to the recess 95-1 adheres to the greater foreign substance ST adhering to the recess 95-2, facilitating movement of the foreign substance ST from the circumferential face 94-1 of the heating roller 91 to the circumferential face 94-2 of the pressure roller 92. Accordingly, movement of the foreign substance ST from the circumferential face 94-2 of the pressure roller 92 to the circumferential face 94-1 of the heating roller 91 is suppressed. Consequently, staining of the circumferential face 94-1 of the heating roller 91 with the foreign substance ST is suppressed. Additionally, staining of the circumferential face 94-1 of the heating roller 91 is suppressed by a simple mechanism that barely degrades the mechanical strength of the fixing device 9, that is, adjustment of the size of the recesses 95 on the circumferential face 94 of each of the heating roller 91 and the pressure roller 92. Accordingly, the fixing device 9 suppresses staining of the circumferential face 94-1 of the heating roller 91 for an extended period of time.

Figure 7A:
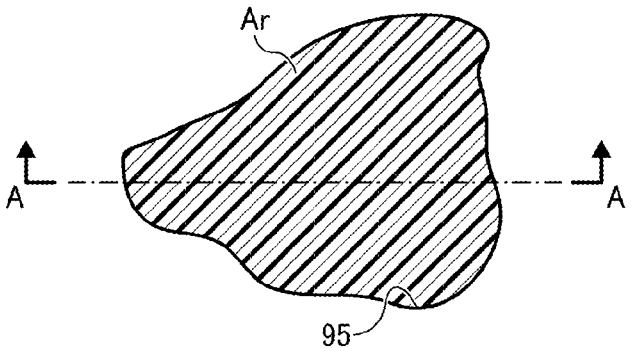
FIG. 7A is a plan view of the recess shown in FIG. 6.
Figure 7B:
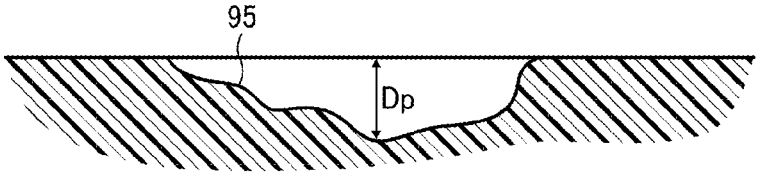
FIG. 7B is a sectional view of the recess taken along line A-A in FIG. 7A.

With reference to FIGS. 7A and 7B, a description is provided of the size of the recess 95-1 on the circumferential face 94-1 of the heating roller 91 and the recess 95-2 on the circumferential face 94-2 of the pressure roller 92.

FIGS. 7A and 7B illustrate the recess 95 produced on the circumferential face 94 of each of the heating roller 91 and the pressure roller 92. FIGS. 7A and 7B schematically illustrate the recess 95 as a recess of each of the heating roller 91 and the pressure roller 92. FIG. 7A is a plan view of the recess 95. FIG. 7B is a sectional view of the recess 95 taken along line A-A in FIG. 7A.

As shown in FIGS. 7A and 7B, the size of the recess 95 is defined by an aperture area Ar not greater than about 0.01 $mm^2$ and a depth Dp not greater than about 5 micrometers. The recess 95 having the size defined as above prevents the foreign substance ST from adhering to each of the circumferential face 94-1 of the heating roller 91 and the circumferential face 94-2 of the pressure roller 92. Thus, the recess 95 suppresses staining of the heating roller 91 further.

The size of the recess 95 defined as above is achieved by defining the size of the additive 93*a* shown in FIG. 5 as below.

The size of the additive 93*a* is defined by a maximum length not greater than about 5 micrometers. The additive 93*a* is one example of an additive according to example embodiments of the present disclosure. Accordingly, the size of the recess 95 is decreased as described above, thus suppressing staining of the heating roller 91 incorporated in the fixing device 9 further.

The image forming apparatus 1 employs toner containing inorganic fine particles such as silica as an external additive directed to enhance charging property. If the inorganic fine particles adhere to the circumferential face 94-1 of the heating roller 91 and the circumferential face 94-2 of the pressure roller 92, the inorganic fine particles may serve as a binder that binds the foreign substances ST and accelerate adhesion of the foreign substances ST to the heating roller 91 and the pressure roller 92. To address this circumstance, the recesses 95 are provided on the surface layer 93 of each of the heating roller 91 and the pressure roller 92, preventing or reducing adhesion of the foreign substances ST to the surface layer 93. Accordingly, even if the image forming apparatus 1 employs toner containing inorganic fine particles in a certain amount as an external additive, the recesses 95 suppress adhesion of the foreign substances ST to the heating roller 91 and the pressure roller 92.

Figure 8:
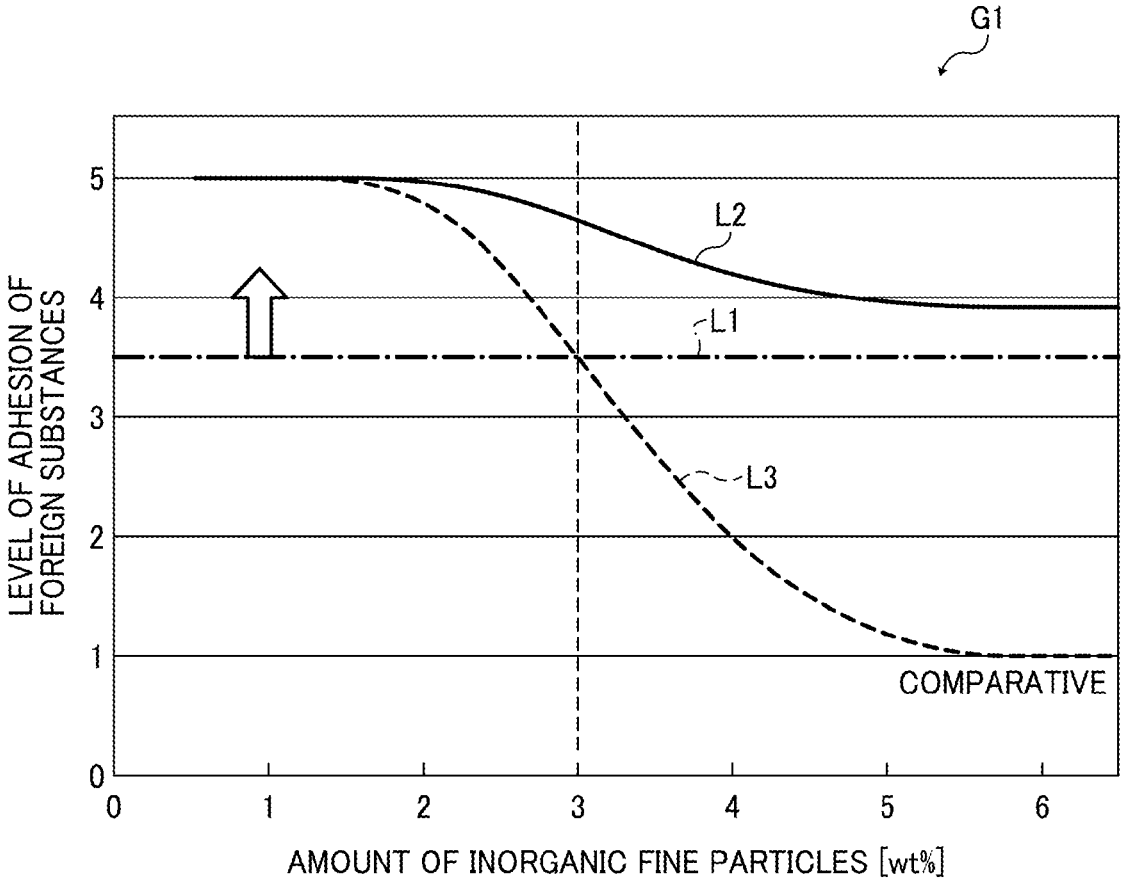
FIG. 8 is a graph showing a relation between an amount of inorganic fine particles contained in toner and a level of adhesion of foreign substances to the surface layer shown in FIG. 5.

FIG. 8 is a graph G1 showing a relation between an amount of the inorganic fine particles contained in toner and a level of adhesion of the foreign substances ST to the surface layer 93. In the graph G1 shown in FIG. 8, a horizontal axis represents the amount of the inorganic fine particles contained in toner indicated by weight percent. A vertical axis represents the level of adhesion of the foreign substances ST to the surface layer 93 as an indicator showing an amount of the foreign substances ST adhered to the surface layer 93. The smaller the level of adhesion of the foreign substances ST to the surface layer 93, the greater the amount of the foreign substances ST adhered to the surface layer 93. If the level of adhesion of the foreign substances ST to the surface layer 93 is not smaller than 3.5, the foreign substances ST barely or slightly affect quality of the toner image T formed on the recording medium S adversely. In the graph G1, a threshold of 3.5 as the level of adhesion of the foreign substances ST to the surface layer 93 is indicated by an alternate long and short dash line L1.

The relation between the amount of the inorganic fine particles contained in toner and the level of adhesion of the foreign substances ST to the surface layer 93 in the image forming apparatus 1 incorporating the fixing device 9 according to this example embodiment is indicated by a solid line L2. The relation between the amount of the inorganic fine particles contained in toner and the level of adhesion of the foreign substances ST to the surface layer 93 in a comparative image forming apparatus incorporating a heating roller and a pressure roller that include a surface layer without the recesses 95 is indicated by a dotted line L3. As shown by the dotted line L3, with the comparative image forming apparatus, when the amount of the inorganic fine particles contained in toner is not smaller than 3 weight percent, the level of adhesion of the foreign substances ST to the surface layer is below the threshold of 3.5. Conversely, even when the amount of the inorganic fine particles contained in toner is relatively great, for example, 3 weight percent or greater, the level of adhesion of the foreign substances ST to the surface layer 93 is not smaller than the threshold of 3.5. Thus, the recesses 95 attain advantages when the amount of the inorganic fines particles contained in toner is relatively great.

The configuration of the fixing device 9 is not limited to that of the example embodiments described above.

For example, the heating roller 91 is shown as one example of a heating rotator that heats a recording medium S. However, the heating rotator is not limited to the heating roller 91. For example, the heating rotator may be a fixing belt or the like constructed of a rotatable endless belt heated by a heater.

Further, the heating roller 91 is shown as one example of a heating rotator heated by a halogen heater serving as a heater or a heat source that heats the heating rotator. However, the heating rotator is not limited to the heating roller 91. For example, the heating rotator may be heated by a ceramic heater serving as a heater or a heat source that heats the heating rotator. Alternatively, the heating rotator may include an inner metal layer heated by induction heating.

Further, the tandem image forming apparatus 1 is shown as one example of an image forming apparatus. However, the image forming apparatus is not limited to the tandem image forming apparatus 1. For example, the image forming apparatus may be a rotary type color image forming apparatus or a monochrome image forming apparatus.

A description is provided of advantages of the fixing device 9 described above.

As shown in FIG. 3, the fixing device 9 includes a heating rotator (e.g., the heating roller 91) rotatable while being heated and a pressure rotator (e.g., the pressure roller 92)

pressed against the heating rotator to form the fixing nip N therebetween while the pressure rotator rotates. As a recording medium S (e.g., a sheet) bearing a toner image T is conveyed through the fixing nip N, the heating rotator and the pressure rotator fix the toner image T on the recording medium S. As shown in FIG. 5, the plurality of recesses 95 is scattered on the circumferential face 94 of each of the heating rotator and the pressure rotator. As shown in FIG. 6, each of the recesses 95-1 on the circumferential face 94-1 of the heating rotator is smaller than each of the recesses 95-2 on the circumferential face 94-2 of the pressure rotator. That is, each of the recesses 95-2 on the circumferential face 94-2 of the pressure rotator is greater than each of the recesses 95-1 on the circumferential face 94-1 of the heating rotator.

Accordingly, even if the foreign substances ST are adhered to the recesses 95, the foreign substances ST do not move from the circumferential face 94-2 of the pressure rotator to the circumferential face 94-1 of the heating rotator, suppressing staining of the circumferential face 94-1 of the heating rotator.

According to the example embodiments described above, the heating roller 91 serves as a heating rotator. Alternatively, an endless belt or the like may be used as a heating rotator. Further, the pressure roller 92 serves as a pressure rotator. Alternatively, an endless belt or the like may be used as a pressure rotator.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

a heating rotator including a plurality of first recesses arranged on a circumferential face of the heating rotator; and a pressure rotator including a plurality of second recesses arranged on a circumferential face of the pressure rotator, the pressure rotator configured to be pressed against the heating rotator to form a fixing nip therebetween, through which a recording medium bearing a toner image is conveyed, wherein each of the plurality of second recesses being greater than each of the plurality of first recesses, wherein each of the heating rotator and the pressure rotator includes a surface layer containing an additive that is removed and forms one of the plurality of first recesses and the plurality of second recesses, and wherein each of the plurality of first recesses and the plurality of second recesses has an aperture area not greater than about 0.01 $mm^2$ and a depth not greater than about 5 micrometers.

2. The fixing device according to claim 1, wherein the heating rotator includes a heating roller.

3. The fixing device according to claim 1, wherein the pressure rotator includes a pressure roller.

4. The fixing device according to claim 1, wherein a size of the plurality of first recesses and the plurality of second recesses on the respective circumferential faces is adjusted by decreasing the size of the additive contained in the surface layer of the heating rotator relative to the size of the additive contained in the surface layer of the pressure rotator.

5. The fixing device according to claim 1, wherein a size of the additive has a maximum length of about 5 micrometers.

6. The fixing device according to claim 1, wherein each of the plurality of first recesses and the plurality of second recesses are arranged on the circumferential face of the heating rotator and the pressure rotator, respectively.

7. The fixing device according to claim 1, wherein the heating rotator houses a heat source that heats the heating rotator.

8. The fixing device according to claim 7, wherein the heat source includes two halogen heaters.

9. A fixing device comprising:

a heating rotator including a plurality of first recesses arranged on a circumferential face of the heating rotator; and a pressure rotator including a plurality of second recesses arranged on a circumferential face of the pressure rotator, the pressure rotator configured to be pressed against the heating rotator to form a fixing nip therebetween, through which a recording medium bearing a toner image is conveyed, wherein each of the plurality of second recesses being greater than each of the plurality of first recesses, wherein each of the plurality of first recesses and the plurality of second recesses has an aperture area not greater than about 0.01 $mm^2$ and a depth not greater than about 5 micrometers.

10. The fixing device according to claim 9, wherein each of the plurality of first recesses and the plurality of second recesses has a length not greater than about 5 micrometers.

11. The fixing device according to claim 10, wherein the surface layer is made of resin.

12. An image forming apparatus comprising:

an image forming device configured to form a toner image; and a fixing device, downstream from the image forming device in a recording medium conveyance direction, configured to fix the toner image on a recording medium, the fixing device including:

a heating rotator including a plurality of first recesses arranged on a circumferential face of the heating rotator; and a pressure rotator including a plurality of second recesses arranged on a circumferential face of the pressure rotator, the pressure rotator configured to be pressed against the heating rotator to form a fixing nip therebetween, through which the recording medium bearing the toner image is conveyed, wherein each of the plurality of second recesses being greater than each of the plurality of first recesses, wherein each of the heating rotator and the pressure rotator includes a surface layer containing an additive that is removed and forms one of the plurality of first recesses and the plurality of second recesses and, wherein each of the plurality of first recesses and the plurality of second recesses has an aperture area not greater than about 0.01 $mm^2$ and a depth not greater than about 5 micrometers.

* * * * *